United States Patent [19]

Umlauf, Jr.

[11] Patent Number: 5,031,879

[45] Date of Patent: Jul. 16, 1991

[54] STAKE EXTRACTION IMPLEMENT

[76] Inventor: Gerald J. Umlauf, Jr., 7222 Trumble La., St. Clair, Mich. 48079

[21] Appl. No.: 450,574

[22] Filed: Dec. 14, 1989

[51] Int. Cl.[5] ..... B66F 11/00

[52] U.S. Cl. ..... 254/129; 254/22

[58] Field of Search ..... 254/21, 22, 23, 25, 254/27, 121, 129, 130, 131, 132

[56] References Cited

U.S. PATENT DOCUMENTS

| | | | |
|---|---|---|---|
| 328,655 | 10/1885 | Corning et al. | 254/21 |
| 802,588 | 10/1905 | Parks et al. | 254/130 |
| 2,906,498 | 9/1959 | Erwin | 254/25 |
| 4,746,098 | 5/1988 | Abarotin | 254/130 |

*Primary Examiner*—Robert C. Watson

*Attorney, Agent, or Firm*—Peter D. Keefe

[57] ABSTRACT

A stake extraction implement for primary utilization with respect to stakes used for concrete forms. The stake extraction implement is composed of an elongate member, incorporating a handle portion and a curved portion, and a pivotally connected gripper tool, incorporating a pair of jaws. When a stake is to be extracted, the curved portion of the elongate member is placed upon the adjacent concrete form and the jaws of the gripper tool are aligned to rest upon the sides of the subject stake. According to the method of use disclosed, as a lever movement of the handle portion is effected, effortless extraction of the stake from the ground is made possible by automatic clamping of the jaws of the gripper tool onto the stake, the stake having been nailed to the concrete form notwithstanding. The stake pulling implement is structured to permit user selection of either a first class or second class lever mode of operation, and two types of jaw members for the gripper tool are disclosed.

7 Claims, 3 Drawing Sheets

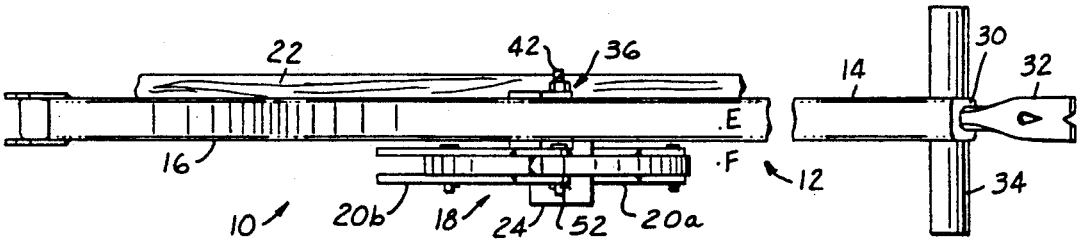
FIG. 2
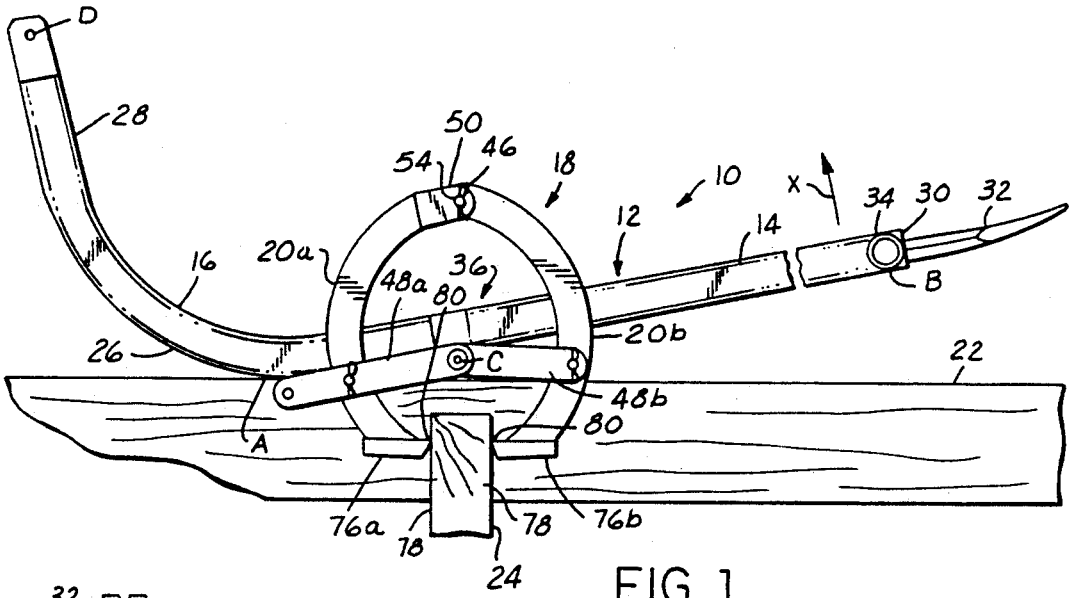
FIG. 1
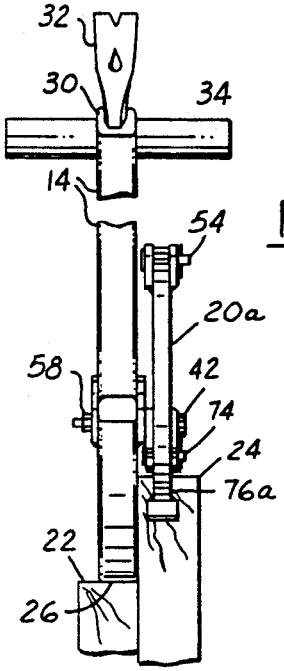
FIG. 4
FIG. 3
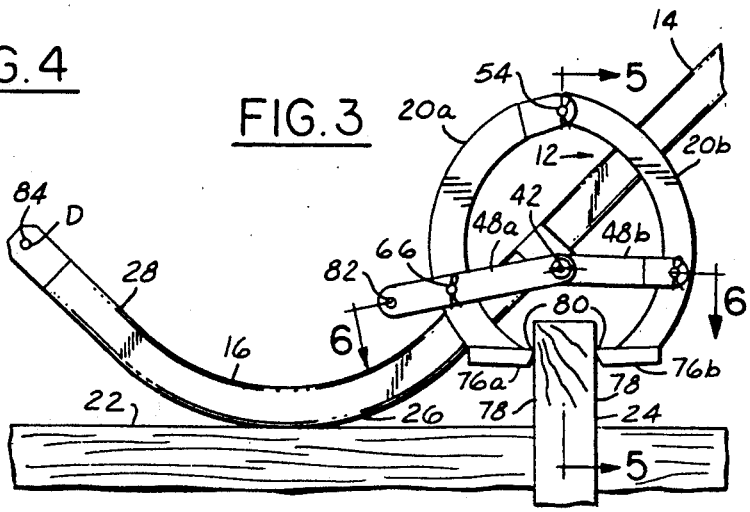

STAKE EXTRACTION IMPLEMENT

BACKGROUND OF THE INVENTION

1. Field of the Invention

The present invention relates to devices for pulling stakes, particularly stakes used to hold forms that are used in concrete construction. The present invention relates more particularly to a stake puller which enables removal of the stake by combined clamping and pulling operations.

2. Description of the Prior Art

Stakes are utilized widely as a means of securing objects relative to the ground. The most common stake material is wood, although other materials such as metal or plastic are also used. A principal use of stakes is in the construction trades, where stakes are driven into the ground in order to serve as positioning anchors for forms used in connection with the pouring of cement. These stakes are generally rectangular in shape, have a pointed end for facilitating being driven into the ground, and a flat surface for abutting the adjacent concrete form, to which it is then attached, usually by nailing.

After pouring and upon hardening of the concrete, it is desired to remove the concrete forms and their associated anchoring stakes. Conventionally, this process is extremely time and effort demanding because the stakes are generally pounded into the ground to a significant depth, and the area immediately surrounding the stakes is frequently strewn with spilled, hardened concrete. Adding to the toil, is the fact that the stakes have been nailed to the concrete forms, requiring added efforts to secure release of the stakes. Still further, adding to the level of toil, is the fact that concrete forms frequently run for long distances and a large number of stakes are involved which must each be individually pulled. The net result is a back-breaking job, that must consume the full attention of at least one workman until the job is finished.

In the prior art, there are examples of attempts to remedy the aforesaid stake pulling dilemma. One recent example is U.S. Pat. No. 4,671,493 to Ravencroft, dated June 9, 1987, which discloses a stake puller for concrete forms, in which a scissor-type action is used to grip the stake, and a lever action is used to uproot the stake, where the fulcrum is the top of the concrete form adjacent the stake. Another recent example is U.S. Pat. No. 4,817,917 to Stultz et al, dated Apr. 4, 1989, which discloses a stake puller for concrete forms which is remarkably similar in structure and function to U.S. Pat. No. 4,671,493.

While the aforesaid prior art solutions offer a device which can facilitate removal of stakes, the process nonethe-less involves drudgery in that there must be a long series of ratchet-like levering and re-clamping actions before the stake can be successfully extracted from the ground.

Accordingly, what is needed is a simple, effective, single action implement that can pull stakes out the ground in one simple and very convenient movement.

SUMMARY OF THE INVENTION

The present invention is a stake extraction implement for primary utilization with respect to stakes used for concrete forms. The stake extraction implement is composed of an elongate member, incorporating a handle portion and a curved portion, and a pivotally connected gripper tool, incorporating a pair of jaws.

When a stake is to be extracted, the curved portion of the elongate member is placed upon the adjacent concrete form and the jaws of the gripper tool are aligned to rest upon the sides of the subject stake. As a lever movement of the handle portion is effected, extraction of the stake from the ground is made possible by automatic clamping of the jaws of the gripper tool onto the stake, the stake having been nailed to the concrete form notwithstanding.

The stake pulling implement is structured to permit user selection of either a first class or second class lever mode in order to secure stake extraction, and two types of jaw members for the gripper tool are disclosed.

Accordingly, it is an object of the present invention to provide a stake extraction implement which requires of the user only a singular movement in order to secure stake extraction.

It is another object of the present invention to provide a stake extraction implement which includes a gripper tool having jaws which are structured to inherently grip and clamp onto a stake when extraction is undertaken.

It is yet a further object of the present invention to provide a stake extraction implement which permits the user to preselect the mode of operation, being either that of a first class or second class lever.

These, and additional objects, advantages, features and benefits of the present invention will become apparent from the following specification.

BRIEF DESCRIPTION OF THE DRAWINGS

FIG. 1 is a side view of the stake extraction implement according to the present invention, showing an initial stage of operation with a first preferred form of gripper tool. The gripper tool is shown located between the curved portion and the handle portion in order to provide a second class lever mode of operation.

FIG. 2 is a plan view of the stake extraction tool shown in FIG. 1.

FIG. 3 is a partial side view of the stake extraction implement, as shown in FIG. 1, now seen at a later stage of operation.

FIG. 4 is an end view of the stake extraction tool according to the present invention, as shown in FIG. 3.

DETAILED DESCRIPTION OF THE PREFERRED EMBODIMENT

Figure 5:
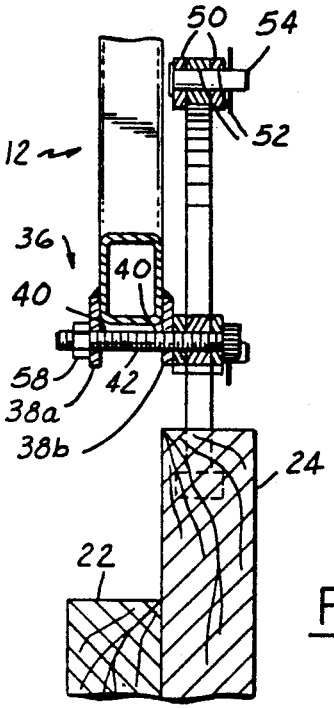
FIG. 5 is a detail part sectional side view of the stake extraction implement according to the present invention, as seen along lines 5—5 in FIG. 3.

Referring now to the Drawing, FIGS. 1 and 2 depict, generally, the stake extraction implement 10 according to the present invention. It will be seen from these Figures, that the stake extraction implement is composed of an elongate member 12, the elongate member having a handle portion 14 and a curved portion 16, and, pivotally connected with the elongate member, a gripper tool 18, the gripper tool having a pair of clampably interconnected gripper jaws 20*a* and 20*b*. FIGS. 1 and 2 show the stake extraction implement 10 in a second class lever configuration, in which the lever arm offered by the handle portion between points A and B substantially exceeds the lever arm offered by the handle portion and curved portion between points A and C. An upward thrust at B is therefore, amplified at C by an amount determined by the ratio of the lever arms: AB/AC.

The elongate member 12 is constructed of a strong material such as a metal or high impact plastic. A preferred length of the elongate member 12 is on the order of five feet, with approximately three feet being devoted to the handle portion 14 and approximately two feet being devoted to the curved portion 16. It is preferred that the curved portion subtend an angle of substantially ninety degrees with respect to the handle portion.

Now referencing FIGS. 1 through 4, it is seen that a preferred environment of operation involves the positioning of the curved portion atop a concrete form 22 for the purpose of extracting its associated stake 24. This is accomplished, in brief terms, by the gripper tool 18 gripping the stake 24 when the handle member 12 is at an initial position as indicated at FIG. 1, and then the user thrusting the handle portion upwardly along arrow x to at least the position shown in FIG. 3. Consequently, it is preferred that the elongate member 12 be cross-sectionally dimensioned so that the surface 26 of the curved portion which will make contact with the concrete form 22 is flat relative to the concrete form.

The elongate member 12 is further preferred to have integrally connected an extension member 28 which serves to provide a second lever arm between points A and D, as particularly shown in FIGS. 1 and 3, in which case the stake extraction implement 10 is configured to function as a first class lever, with the mechanical advantage being determined by the ratio of the lever arms: AB/AD. The extension member is preferred to be on the order of one foot in length and has an aperture at point D for connecting the gripper tool 18 thereto.

Further, the elongate member 12 may be provided with, at its opposite end 30 with respect to the extension member 28, a prying bar attachment 32, which is structured to aid in the extraction of recalcitrant nails and the disassembly of the stake 24 from its associated concrete form 22.

Also, it is preferred to include a transverse handle 34 adjacent the remote end 30, which serves to aid user movement of the handle portion 12 when the stake 24 is being extracted, but more importantly serves to aid the user in keeping the stake extraction implement 10 in a vertical attitude during stake extraction against the rotational torque generated at point C, this torque being defined by F(s), where F is the force at point C and s is the distance between points E and F, as seen in FIG. 2.

As can be best seen from FIGS. 4 and 5, a connection member 36 is interconnected with handle portion 14 at point C. The connection member is preferred to be structured in the form of two plates 38*a* and 38*b* which are welded to the handle portion 14 and protrude downwardly therefrom. An aperture 40 is provided in each plate 38*a* and 38*b*, so that a bolt 42 may pass therethrough, the gripper tool 18 being rotatably connected with the bolt.

The gripper tool 18, as can be seen from FIGS. 1 through 6, is composed of two gripper jaws 20*a* and 20*b* which are mutually pivotably joined at a joint 46 and which are movably conjoined by a pair of cross-arms 48*a* and 48*b*, which are, in turn, pivotably connected with the bolt 42 at point C.

Each gripper jaw 20*a* and 20*b* is preferred to be shaped in a somewhat elongate semicircular configuration, whereby when the two gripper jaws are connected at the joint 46, a general "horse shoe" shape is presented. At the joint 46, each of the gripper jaws overlap one another, in that gripper jaw 20*a* has a clevis end 50 into which gripper jaw 20*b* is inserted. At the point of this overlap, an aperture 52 is provided in each of the gripper jaws so that a pin 54 may pass therethrough and is held in place by a cotter pin.

Each cross-arm 48*a* and 48*b* is structured to mutually overlap at the location of connection with bolt 42, in that cross-arm 20*a* is constructed of two straps 48*a*' which are spaced mutually apart in order to permit cross-arm 48*b* to insert therebetween. An aperture 56 is provided in each cross-arm at the location of this intersection so that the bolt 42 may pass therethrough. A nut 58 is used to secure the cross-arms relative to the bolt 42.

Figure 6:
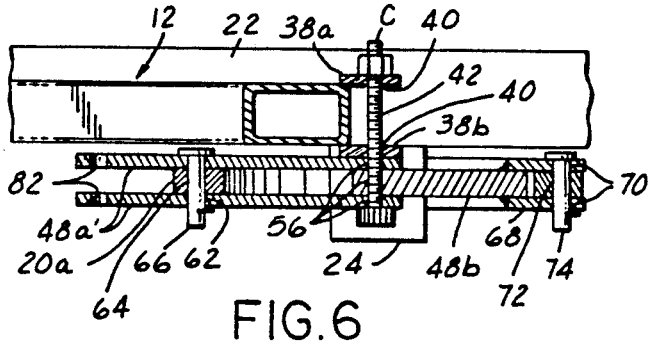
FIG. 6 is a detail part sectional plan view of the stake extraction implement according to the present invention, as seen along lines 6—6 in FIG. 3.

Each cross-arm 48*a* and 48*b* connects to a respective gripper jaw, as can best be seen by reference to FIGS. 1, 3 and 6. The separation of the two straps 48*a*' of cross-arm 48*a* also permits gripper jaw 20*a* to insert therebetween. An aperture 62 is provided in the two straps 48*a*' and an aperture 64 is provided in the gripper jaw 20*a*. These two apertures 62 and 64 are aligned and a pin 66 is inserted thereinto. A clevis 68 is provided in the end of the cross-arm 48*b* and an aperture 70 is provided therethrough. An aperture 72 is provided in gripper jaw 20*b* which is aligned with the aperture in the clevis 68 so that a pin 74 may be inserted therethrough. Thusly, the gripper jaws 20*a* and 20*b* have a four-point joint action at pins 54, 66 and 74 and bolt 42.

Each gripper jaw ends remotely from joint 46 in a biting member 76*a* and 76*b*, respectively. Each of the biting members opposes the other in substantially a plane, the plane being oriented perpendicularly to the sidewalls 78 of the stake 24. It is preferred that the biting members present a pointed surface 80 to the stake surface 78 in order that the biting members may tend to gripably clamp the stake as the handle portion 12 is moved upwardly, as described above. To facilitate this desired result, it is preferred that the pointed surface 80 of each of the biting members be beveled in a direction generally toward the bolt 42, as shown in FIGS. 1 and 3.

Figure 7:
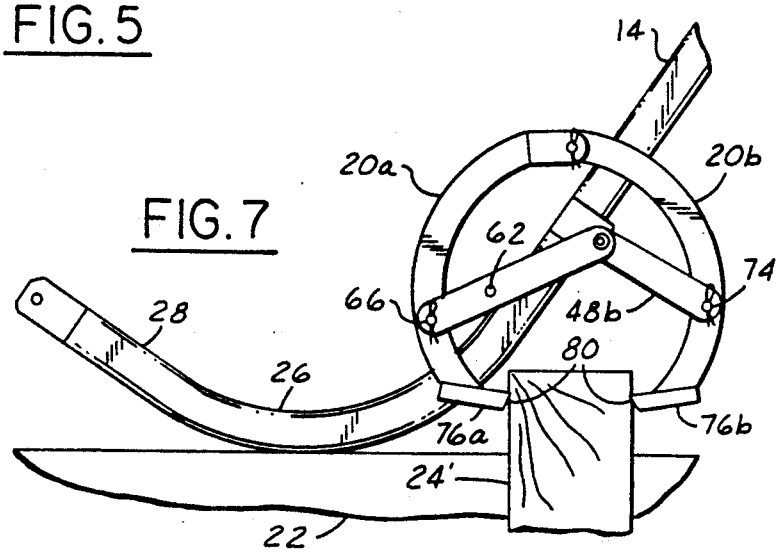
FIG. 7 is a partial side view of the stake extraction implement according to the present invention engaging a "2×4" sized stake.

Since both "1×3" and "2×4" standard size wooden stakes are common, the gripper tool 18 is preferred to be structured to allow for accommodation of both these standard sizes of standard construction grade lumber. FIG. 3 shows the gripper tool 18 used with a "1×3", or the like, sized stake 24. To use the gripper tool with a "2×4" stake, pin 66 is removed and gripper jaw 20*a* moved so that aperture 62 is aligned with an outer aperture 82 in the cross-arm 48*a*. Pin 66 is then reinserted. Now, the gripper tool can accommodate a "2×4", or the like, sized stake 24', as shown particularly in FIG. 7.

In operation, the user would place the stake extraction implement adjacent a stake to be pulled so that the curved portion rests atop the concrete form and the gripper jaws rest against the sidewalls of the stake.

When the stake extraction implement is operated in a second class lever mode, the gripper tool is attached to the elongate member as shown in FIG. 1. To remove the stake, the stake extraction implement is positioned so that the handle portion is near the concrete form, and the handle portion is raised upwardly from the concrete form board along direction x in FIG. 1. As this is performed, the curved portion serves to provide a continuous fulcrum point along its curved surface which is in contact with the concrete form, and the biting members dig into the stake to force the stake to rise out of the ground as the gripper tool moves upwardly.

Figure 8:
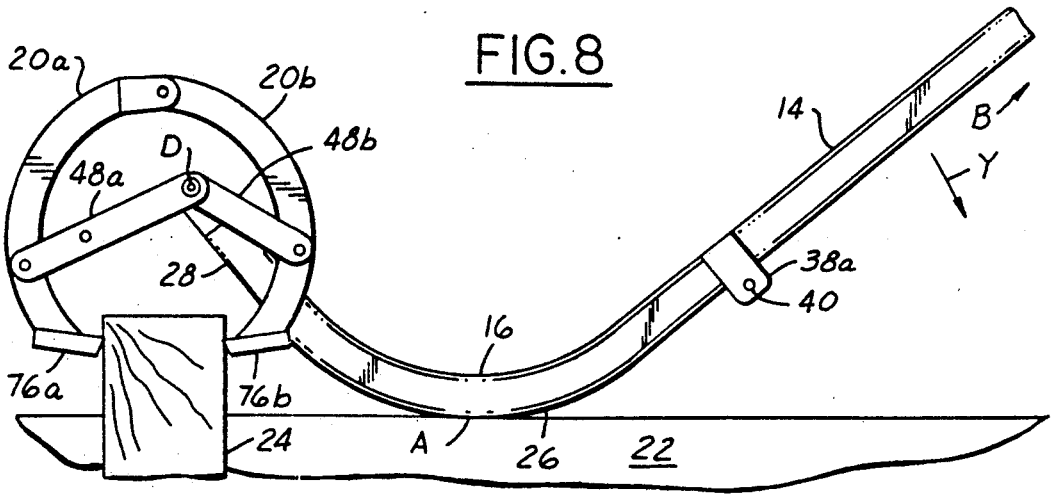
FIG. 8 is a partial side view of the stake extraction implement according to the present invention in which the gripper tool is now located on the extension member in order to provide a first class lever mode of operation.

When the stake extraction implement is operated in a first class lever mode, the gripper tool is attached to the elongate member as shown in FIG. 8, where the bolt 42 now passes through aperture 84 in the extension member 28. To remove the stake, the stake extraction implement is positioned so that the handle portion is above the concrete form, and the handle portion is lowered downwardly toward the concrete form board in the direction y in FIG. 8. As this is performed, the curved portion serves to provide a continuous fulcrum point along its curved surface which is in contact with the concrete form board, and the biting members dig into the stake to force the stake to rise out of the ground as the gripper tool moves upwardly.

In either case of mode of operation, it is to be understood that the gripper tool is able to secure adequate gripping of the stake because as the handle portion is moved so as to extract the stake, the linear movement at bolt 42 causes a clamping (pinching) movement with respect to joints 46 which translates into the pointed surface 80 of the biting members 76*a* and 76*b* pressing tightly against the sidewalls of the stake. This result is achieved by allowing pivotable movement at pin 54, at bolt 42 and at pins 66 and 74.

FIGS. 9 through 12 show the stake extraction implement now with an alternative gripper tool 86.

Figure 10:
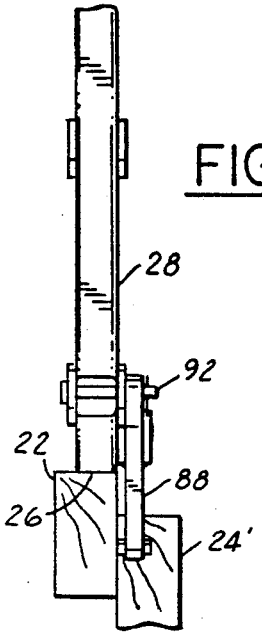
FIG. 10 is a partial rear view of the stake extraction implement as seen in FIG. 9.
Figure 9:
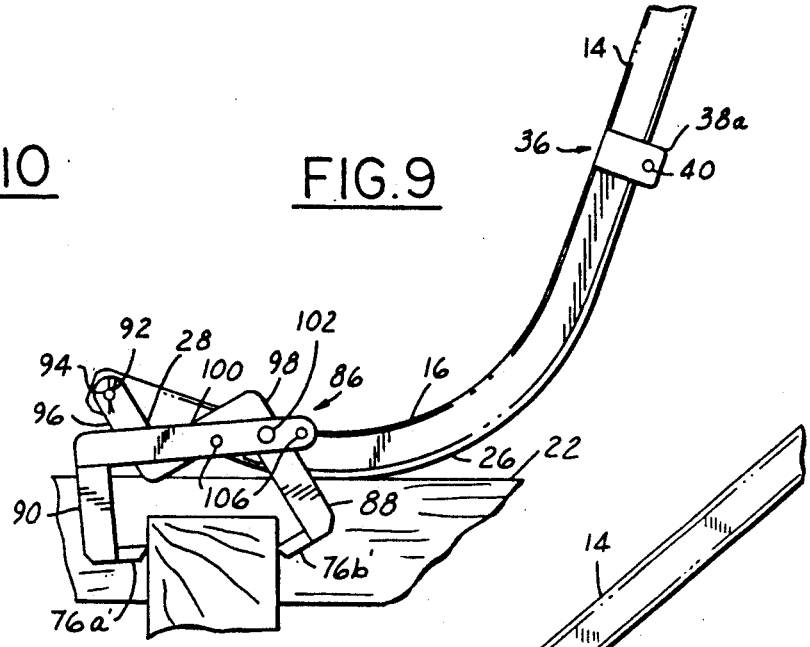
FIG. 9 is a partial side view of the stake extraction implement according to the present invention, now including an alternative gripping tool mounted for operation in a first class lever mode.
Figure 11:
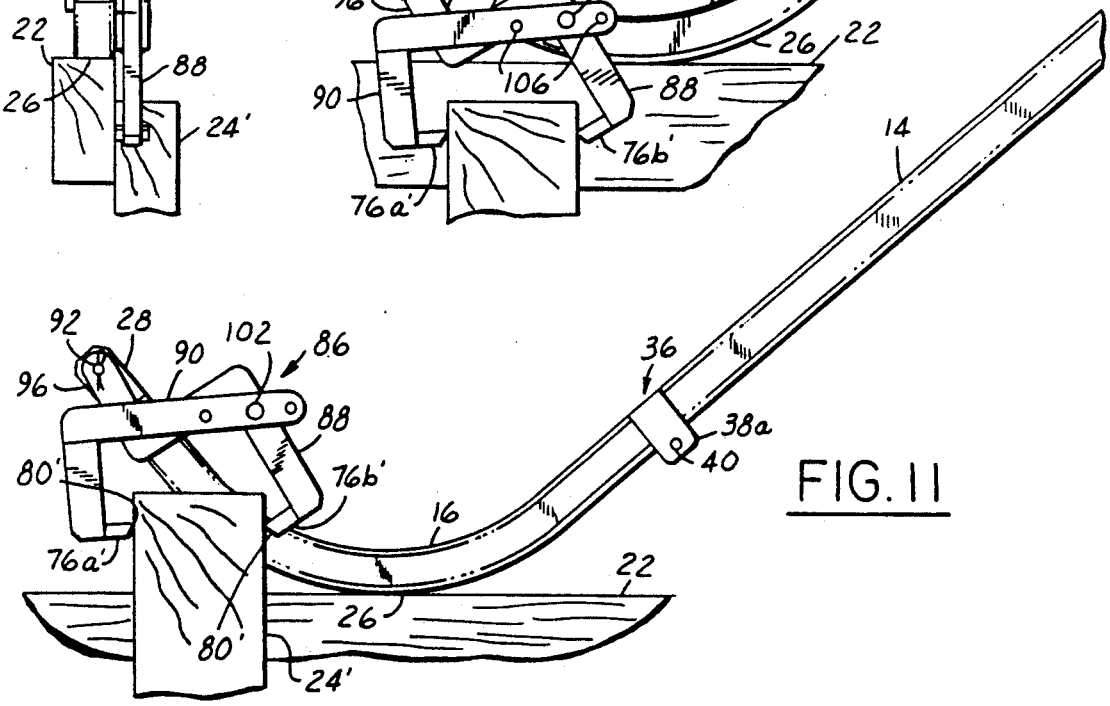
FIG. 11 is a partial side view of the stake extraction implement according as shown in FIG. 9, now showing the stake partially extracted by operation of the invention.

Referring firstly to FIGS. 9 through 11, it is seen that the alternative gripper tool 86 is composed of two components, an active jaw 88 and a reactive jaw 90. The active jaw is connected pivotably to the extension member 28 via a pin 92 which passes through an aperture 94 in a stand-off section 96 of the active jaw 88. Integrally connected to the stand-off section 96 is an "L" shaped jaw section 98 having a biting member 76*b'* located at its end. The reactive jaw 90 is connected pivotably to the active jaw 88 via a clevis section 100 into which the active jaw inserts, the reactive jaw being secured to the active jaw by a pin 102 which passes through aligned apertures in the clevis portion 94 as well as the active jaw at the "L" shaped section 98. A series of apertures 106 are provided for the pin 102 to selectively pass through in order that various dimensioned stakes (such as "1×3" and "2×4" discussed above) may be accommodated. A straight section 104 connects with the clevis section 100 and a biting member 76*a'* is located at the end of the straight section.

When the stake extraction implement is operated in a first class lever mode, as described above, the alternative gripper tool is attached, as indicated above, to the elongate member in the configuration shown in FIGS. 9 through 11, where the pin 92 passes through aperture 84 in the extension member 28. To remove the stake, the stake extraction implement is positioned so that the handle portion is above the concrete form, and the handle portion is lowered downwardly toward the concrete form. As this is performed, the curved portion serves to provide a continuous fulcrum point along its curved surface which is in contact with the concrete form, and the biting members dig into the stake to force the stake to rise out of the ground as the alternative gripper tool moves upwardly.

Figure 12:
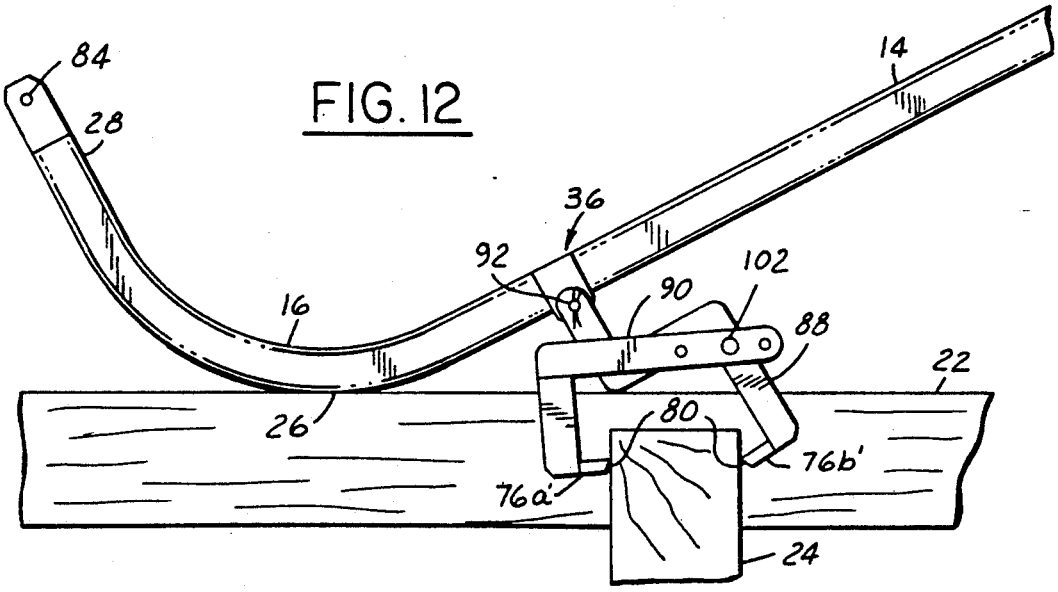
FIG. 12 is a partial side view of the stake extraction implement according to the present invention, now showing the alternative gripper tool mounted for operation in a second class lever mode.

FIG. 12 shows the stake extraction implement operating in a second class lever mode, where the alternative gripper tool is now attached at the connection member 36, where the pin 92 now passes through the aperture 40 in the plates 38*a* and 38*b*.

When the stake extraction implement is operated in a second class lever mode, as described above, the alternative gripper tool is attached to the elongate member as shown in FIG. 12. To remove the stake, the stake extraction implement is positioned so that the handle portion is near the concrete form, and the handle portion is raised upwardly from the concrete form. As this is performed, the curved portion serves to provide a continuous fulcrum point along its curved surface which is in contact with the concrete form, and the biting members dig into the stake to force the stake to rise out of the ground as the alternative gripper tool moves upwardly.

In either case of mode of operation, it is to be understood that the alternative gripper tool is able to secure adequate gripping of the stake because as the handle portion is moved so as to extract the stake, the linear movement at pin 92 causes a clamping (pinching) movement with respect to the pivot point at pin 102 which translates into the pointed surface 80' of each of the biting members 76*a'* and 76*b'* biting into the stake. This result is achieved by allowing pivotable movement at pin 92 and at pin 102.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A stake extraction implement for extracting a stake, said stake extraction tool comprising:

an elongate member, said elongate member comprising a handle portion and a curved portion interconnected with said handle portion;

gripper tool means pivotably connected to said elongate member for clampably gripping the stake in order to extract the stake as said handle portion is leverably moved with respect to said curved portion, said gripper tool means comprising:

a first gripper jaw having a first biting member connected thereto;

a second gripper jaw having a second biting member connected thereto, said first and second gripper jaws being mutually interconnected at a first joint;

a first cross arm pivotably connected at a first end thereof with said elongate member at a second joint and pivotably connected at a second end thereof with said first gripper jaw at a third joint; and a second cross arm pivotably connected at a first end thereof with said elongate member at said second joint and pivotably connected at a second end thereof with said second gripper jaw at a fourth joint; and connection means connected with said elongate member and said gripper tool means for pivotably connecting said gripper tool means to said elongate member;

whereby the stake is extracted by said first and second biting members clampably gripping the stake as the handle is leverably moved with respect to said curved portion.

2. The stake extraction tool of claim 1, wherein said elongate member further comprises:

an extension member interconnected with said curved portion at a location opposite said handle portion;

first connection means connected with said handle portion and said gripper tool means for pivotably connecting said gripper tool means selectively to said elongate member so that said leverable movement of said handle portion is a second class lever movement; and second connection means connected with said extension member and said gripper tool means for pivotably connecting said gripper tool means selectively to said elongate member so that said leverable movement of said handle portion is a first class lever movement.

3. The stake extraction tool of claim 2, further comprising accommodation means integral with said gripper tool means for permitting said gripper tool means to clampably gripping various sized stakes.

4. The stake extraction tool of claim 3, further comprising a surface on said curved portion for presenting a flat presentation to a fulcrum located adjacent the stake when said elongate member is leverably moved.

5. The stake extraction tool of claim 4, further comprising a transverse handle connected with said handle portion for assisting a user to counter any torque evidencing while extracting the stake.

6. The stake extraction tool of claim 5, wherein the stake is connected to a concrete form; further comprising means connected with said handle portion for separating the stake from its associated concrete form.

7. A stake extraction implement for extracting a stake, said stake extraction tool comprising:

an elongate member, said elongate member comprising a handle portion and a curved portion interconnected with said handle portion;

gripper tool means pivotably connected to said elongate member for clampably gripping the stake in order to extract the stake as said handle portion is leverably moved with respect to said curved portion, said gripper tool means comprising:

a first gripper jaw having a first biting member connected thereto;

a second gripper jaw having a second biting member connected thereto, said first and second gripper jaws being mutually interconnected at a first joint;

a first cross arm pivotably connected at a first end thereof with said elongate member at a second joint and pivotably connected at a second end thereof with said first gripper jaw at a third joint; and a second cross arm pivotably connected at a first end thereof with said elongate member at said second joint and pivotably connected at a second end thereof with said second gripper jaw at a fourth joint;

an extension member interconnected with said curved portion at a location opposite said handle portion;

first connection means connected with said handle portion and said gripper tool means for pivotably connecting said gripper tool means selectively to said elongate member so that said leverable movement of said handle portion is a second class lever movement; and second connection means connected with said extension member and said gripper tool means for pivotably connecting said gripper tool means selectively to said elongate member so that said leverable movement of said handle portion is a first class lever movement;

whereby the stake is extracted by said first and second biting members clampably gripping the stake as the handle is leverably moved with respect to said curved portion.

* * * * *